US005775485A

United States Patent [19]

Dierking

[11] Patent Number: 5,775,485

[45] Date of Patent: Jul. 7, 1998

[54] VIAL HOLDER APPARATUS

[75] Inventor: James R. Dierking, Portland, Oreg.

[73] Assignee: Liberty Natural Products, Inc., Portland, Oreg.

[21] Appl. No.: 705,801

[22] Filed: Aug. 30, 1996

[51] Int. Cl.[6] ..... B65D 85/30

[52] U.S. Cl. ..... 206/38; 206/528; 206/37

[58] Field of Search ..... 206/528, 530, 206/38, 38.1, 37, 37.1, 37.4, 37.6, 477, 480

[56] References Cited

U.S. PATENT DOCUMENTS

| | | | |
|---|---|---|---|
| 3,863,477 | 2/1975 | Klein | 206/37.1 X |
| 4,333,562 | 6/1982 | Todd | 206/37 |
| 4,765,459 | 8/1988 | Edwards | 206/38.1 |
| 4,812,069 | 3/1989 | White et al. | 206/38 X |

*Primary Examiner*—Jacob K. Ackun
*Attorney, Agent, or Firm*—Ingrid McTaggart

[57] ABSTRACT

In a preferred embodiment, the improved vial holder apparatus comprises a body portion having two pairs of outwardly extending arms and top and bottom outwardly extending supports. The outwardly extending arms and supports together define a central cavity for releasably securing therein a vial. The top support preferably includes an aperture for receiving a ring therein such that the vial holder apparatus may be secured to a necklace or to a key ring along with a set of keys. Accordingly, the vial holder apparatus permits a vial to be securely held within the holder thereby lessening the chance of damage to the vial. The holder also permits the vial to be releasably secured to a necklace or a key chain thereby lessening the chance of loss of the vial.

6 Claims, 2 Drawing Sheets

VIAL HOLDER APPARATUS

The present invention relates to an improved vial holder apparatus, and more particularly to an improved vial holder apparatus that facilitates attachment of a vial to a key chain or necklace while protecting the vial against breakage and allowing for easy removal of the vial from the holder.

BACKGROUND OF THE INVENTION

Many products may be carried within a purse or bag, such as small vials containing breath fresheners, perfumes, materials for aroma therapy and medicine in liquid or tablet form. Carrying such vials within a purse or bag can lead to problems such as breakage of the vial due to rough handling of the purse or bag, breakage of the vial due to contact of the vial with other objects held within the purse or bag and loosening of the vial cap while the vial is held within the purse or bag due to continual contact of the vial cap with other contents of the purse of bag. Other problems may arise such as momentarily losing the vial within the purse or bag, or leaving the vial behind after use due to its inconspicuous size. These problems all create an inconvenience for the person carrying the purse or bag.

Another product people typically carry within their purse or bag is a key chain. Key chains generally are held securely in a convenient pocket within the purse or bag and seldom are lost or left behind due to the importance of the keys attached thereto.

SUMMARY OF THE INVENTION

Accordingly, an object of the present invention is to provide an improved vial holder apparatus adapted for securing a vial therein.

Another object of the present invention is to provide an improved vial holder apparatus which protects the vial against breakage through contact of the vial with other objects held within a purse or bag or through rough handling of the purse or bag.

Yet another object of the present invention is to provide an improved vial holder apparatus which may be connected to a set of keys or necklace such that a vial contained within the holder is not easily lost or left behind.

Still another object of the present invention is to provide an improved vial holder apparatus that facilitates simple removal of the vial from the holder such that the vial may be replaced when its contents have been used.

A further object of the present invention is to provide an improved vial holder apparatus that permits easy viewing of a label on the vial or easy viewing of contents held within a transparent vial.

Still a further object of the present invention is to provide an improved vial holder apparatus that is sleek, lightweight in design and easy to manufacture.

Accordingly, the present invention provides an improved vial holder apparatus that is adapted for securing a vial therein and which protects the vial against breakage through contact of the vial with other objects held within a purse or bag or through rough handling of the purse or bag. Additionally, the present invention provides an improved key chain vial holder that may be connected to a set of keys or a necklace such that a vial contained within the holder is not easily lost or left behind, facilitates simple removal of the vial from the holder such that the vial may be replaced when its contents have been used, permits easy viewing of a label on the vial or easy viewing of contents held within a transparent vial and is sleek, lightweight in design and easy to manufacture.

In a preferred embodiment, the improved vial holder apparatus comprises a body portion having two pairs of outwardly extending arms and top and bottom outwardly extending supports. The outwardly extending arms and supports together define a central cavity for releasably securing therein a vial. The top support preferably includes an aperture for receiving a ring therein such that the vial holder apparatus may be secured to a key ring along with a set of keys. Accordingly, the vial holder apparatus of the present invention permits a vial to be securely held within the holder thereby lessening the chance of damage to the vial. The holder also permits the vial to be releasably secured to a key chain or a necklace thereby lessening the chance of loss of the vial.

The vial holder apparatus preferably is manufactured as one integral unit with the outwardly extending arms and the outwardly extending top and bottom supports bent generally perpendicularly upwardly from a flat base portion. Accordingly, in the preferred embodiment, the vial holder apparatus is relatively lightweight and easy to manufacture.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figures 1, 2, 3, 4, 5:
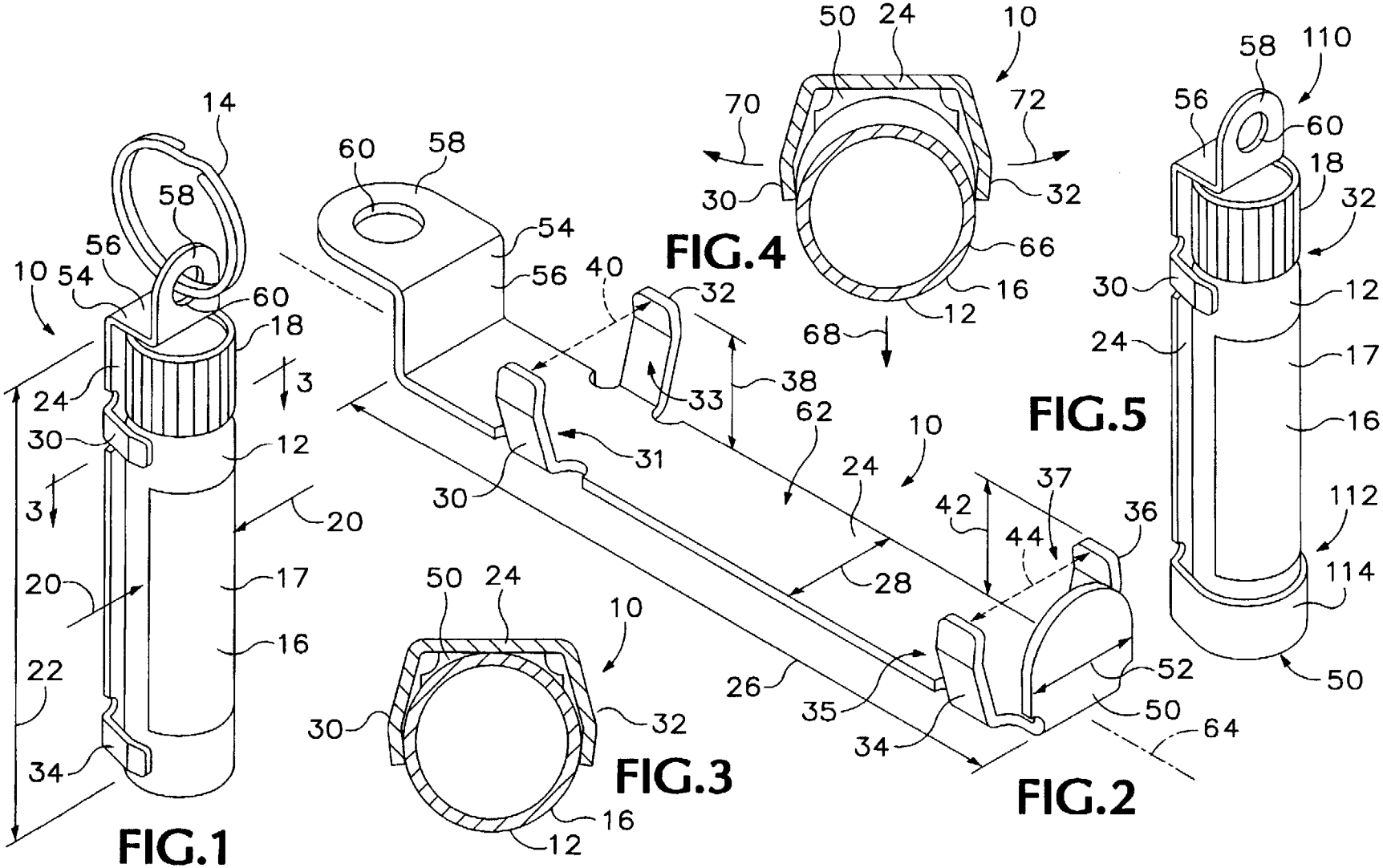
FIG. 1 is an isometric side and front view of the vial holder apparatus of the present invention having a vial secured therein and having a key chain ring connected thereto.
FIG. 2 is an isometric side and front view of the vial holder apparatus wherein the holder does not contain a vial and is not attached to a key chain ring.
FIG. 3 is a cross sectional top view of the vial holder apparatus taken along line 3—3 of FIG. 1.
FIG. 4 is a cross sectional top view of the vial holder apparatus wherein a top portion of the vial is in a position relatively outwardly of the vial holder.
FIG. 5 is an isometric side and front view of another embodiment of the vial holder apparatus.

Referring to FIG. 1, which is an isometric side and front view of the vial holder apparatus of the present invention having a vial secured therein and having a key chain ring connected thereto, the present invention comprises a vial holder apparatus 10 securing therein a vial 12 and being connected to a key chain ring 14. Vial 12 preferably includes a vial body 16, a label 17, and a cap 18. Body 16 preferably is manufactured of transparent glass whereas cap 18 preferably is manufactured of plastic, as known in the art. Cap 18 preferably frictionally fits within an open end of vial body 16 so as to secure solid tablets or a liquid therein. Vial 12 preferably is an elongate hollow cylinder having a diameter 20 of approximately 0.8 cm and a length 22, including cap 18 attached thereto, of approximately 4.0 cm. Key chain ring 14 preferably is a standard overlapping loop type ring such that vial holder 10 and a set of keys (not shown) may simultaneously be releasably secured thereon.

Referring to FIG. 2, which is an isometric side and front view of the key chain vial holder wherein the holder does not contain a vial and is not attached to a key chain ring or a necklace, vial holder 10 preferably includes a generally flat body portion 24 having a length 26 of approximately 4.2 cm and a width 28 of approximately 0.6 cm. Vial holder 10 preferably further comprises an upper pair of arms 30 and 32 and a lower pair of arms 34 and 36 extending generally perpendicularly outwardly from body portion 24. Arms 30 and 32 preferably extend outwardly from body portion 24 a distance 38 of approximately 0.5 cm and define a circular curve having a diameter 40 of approximately 0.8 cm. Similarly, arms 34 and 36 extend outwardly from body portion 24 a distance 42 of approximately 0.5 cm and define a circular curve having a diameter 44 of approximately 0.8 cm.

Still referring to FIG. 2, vial holder 10 further comprises a lower support 50 which extends generally outwardly perpendicularly from body portion 24 and generally adjacent arms 34 and 36. Lower support 50 preferably is generally circular in shape and has a diameter 52 of approximately 0.8 cm.

Vial holder 10 further comprises an upper support 54 including a support region 56 which extends generally outwardly perpendicularly from body portion 24, and an attachment region 58 extending from support region 56 generally parallel to body portion 24. Attachment region 58 preferably includes an aperture 60 sized to releasably secure therein key chain ring 14 or other such attachment means.

Upper support region 56, lower support 50, and arms 30, 32, 34 and 36 define a central cavity 62 having a diameter 40 and a length 26. Accordingly, cavity 62 is sized to receive therein vial 12 or other such similarly shaped device. In the preferred embodiment, arms 30, 32, 34 and 36 are generally circular in shape and each include an angled bend region 31, 33, 35 and 37, respectively, such that a tip of each arm contacts vial 12 when it is positioned within cavity 62. Moreover, the arms are generally rigid but somewhat flexible so as to allow vial 12 to be pressed into cavity 62 and contained therein. Accordingly, arms 30, 32, 34 and 36 prevent a vial 12 contained therein from falling outwardly from vial holder 10 and supports 50 and 54 prevent longitudinal movement of vial 12 outwardly of vial holder 10 along an elongate axis 64.

Referring now to FIG. 3, which is a cross sectional top view of the key chain vial holder taken along line 3—3 of FIG. 1, arms 30 and 32 are shown positioned around vial body 16 of vial 12 such that the tips of the arms contact the vial thereby securing the vial within holder 10. Arms 30 and 32 are manufactured of a tensile strength such that a person can remove the vial but such that routine jostling of the holder will not loosen the vial contained therein.

Referring now to FIG. 4, which is a cross sectional top view of the key chain vial holder wherein a top portion 66 of the vial is in a position relatively outwardly of the vial holder, arms 30 and 32 are shown flexed somewhat outwardly in directions 70 and 72, respectively, so as to permit placement in, or removal of, vial 12 relative to body portion 24. Typically, the vial is removed from holder 10 by first pulling top portion 66 of the vial outwardly in a direction 68, such as by grasping threaded cap 18 (FIG. 1), thereby releasing the vial from upper arms 30 and 32. Second, the vial is further moved in direction 68 thereby releasing the vial from lower arms 34 and 36. Accordingly, arms 30 and 32, and arms 34 and 36, preferably are manufactured of a generally rigid but somewhat flexible material so as to permit movement of the arms in directions 70 and 72 thereby allowing placement and withdrawal of vial 12 from vial holder 10. Vial holder 10 permits, therefore, securement of vial 12 in holder 10 while still allowing the vial to be relatively unenclosed such that label 17, or contents contained within a transparent vial, may easily be viewed.

In the preferred embodiment, vial holder apparatus 10 is stamped from a single sheet of metal, namely lightweight, stress-resistant stainless steel. Thereafter, the arms and support surfaces are bent so as to produce the vial holder as shown in FIG. 1. Vial holder 10 preferably includes indentations adjacent arms 30, 32, 34 and 36, and adjacent lower support 50 so as to facilitate upward bending of those sections relative to body portion 24. Accordingly, vial holder 10 has minimal dimensions, is lightweight, and is relatively easy and inexpensive to manufacture. In a preferred embodiment, the arms and support surfaces have rounded edges so as to prevent damage to objects or to the user. In other embodiments, vial holder 10 may be manufactured of engineered plastic and may be molded as a single unit.

Referring now to FIG. 5, which is an isometric side and front view of another embodiment of the vial holder apparatus, holder 110 comprises flat body portion 24, upper arms 30 and 32, and an annular recess 112 defined by a lower wall 114. Lower wall 114 is generally circular and is integral with lower support 50 so as to define an enclosed area for the seating of vial 12. Accordingly, holder 110 offers more protection against breakage of vial 12 than does holder 10, however, holder 110 is more expensive to manufacture than is holder 10.

Figure 6:
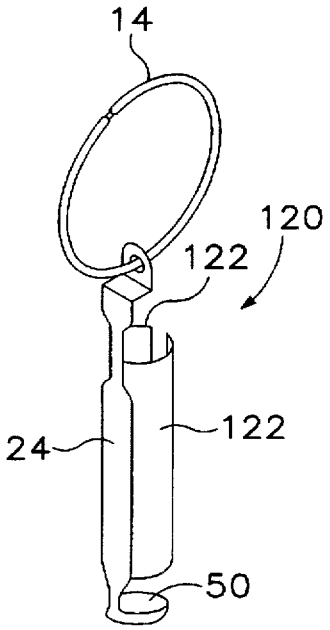
FIG. 6 is an isometric side and rear view of another embodiment of the vial holder apparatus.

Referring now to FIG. 6, which is an isometric side and rear view of another embodiment of the vial holder apparatus, holder 120 comprises flat body portion 24, a pair of arms 122 that extend generally the length of body portion 24, and a lower support 50. Arms 122 generally are circular, similar to arms 30 and 32, so as to define an enclosed area for the seating of vial 12. Holder 120, however, is more expensive to manufacture than is the preferred embodiment in that holder 120 requires a greater amount of material, such as stainless steel, to manufacture the device than is required to manufacture holder 10.

Figure 7:
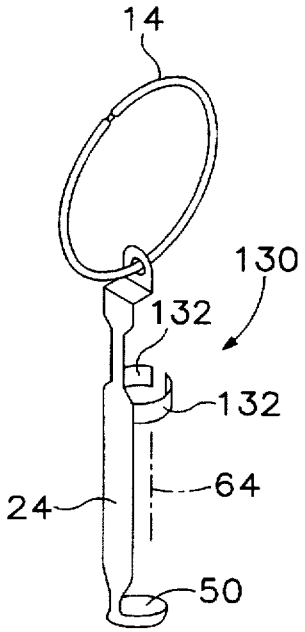
FIG. 7 is an isometric side and rear view of another embodiment of the vial holder apparatus.

Referring now to FIG. 7, which is an isometric side and rear view of another embodiment of the vial holder apparatus, holder 130 comprises a single pair of arms 132 extending outwardly from body portion 24, and a lower support 50. Holder 130 is similar to the preferred embodiment of holder 10 in that holder 130 includes arms 132 of a shape similar to arms 30 and 32. However, due to the incorporation of only a single pair of arms in holder 130, a vial may move slightly with respect to axis 64 such that the vial is not held completely stable within holder 130.

Figure 8:
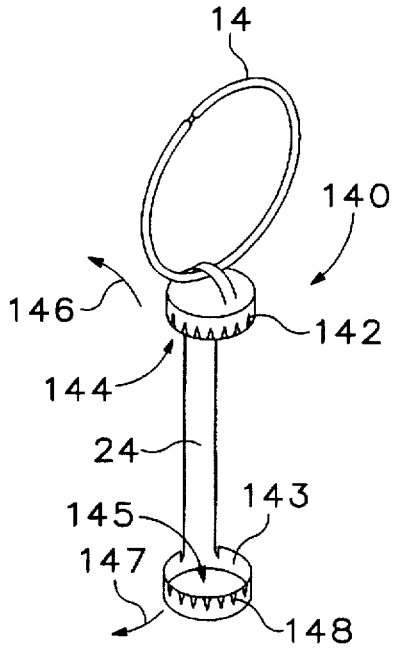
FIG. 8 is an isometric side and front view of another embodiment of the vial holder apparatus.

Referring now to FIG. 8, which is an isometric side and front view of another embodiment of the vial holder apparatus, holder 140 comprises upper and lower supports 142 and 143, respectively, that define annular recesses 144 and 145, respectively. A vial is secured within holder 140 by flexing base 24 such that upper support 142 is moved upwardly and rearwardly in a direction 146 and lower support 143 is moved downwardly and rearwardly in a direction 147. In this manner, a vial may then be positioned within annular recess 145, and then annular recess 144 is returned to its nominal position thereby surrounding an upper portion of the vial cap. Supports 142 and 143 preferably are pressed from a single flat piece of material such that the supports have creases 148 along their generally circular periphery. Accordingly, holder 140 does not include smooth, round edges such that holder 140 may lead to damage of other contents held within a purse or bag.

Figure 9:
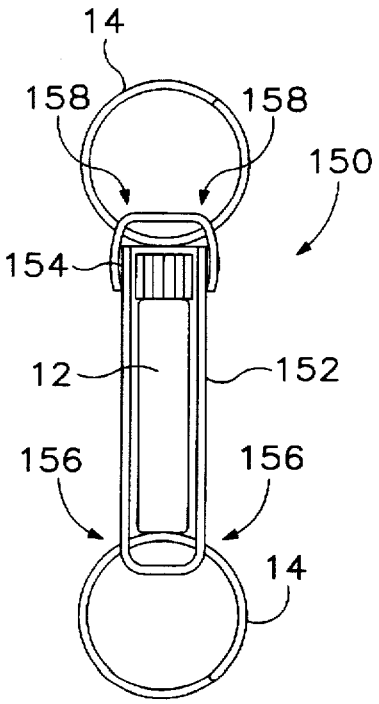
FIG. 9 is a cross sectional side view of another embodiment of the vial holder apparatus.

Referring now to FIG. 9, which is a cross sectional side view of another embodiment of the vial holder apparatus, holder 150 comprises a lower body portion 152 and a cap portion 154 that is frictionally secured thereto. In the preferred embodiment, body 152 includes apertures 156 so as to permit securement of a key chain ring 14 therein. Similarly, cap 154 includes apertures 158 so as to secure a key chain ring 14 or a necklace therein. In the preferred embodiment of holder 150, body 152 and cap 154 are manufactured of glass so as to completely surround a vial 12 while still permitting viewing of the vial. Holder 150 facilitates attachment of two key rings but is more expensive to manufacture than is the preferred embodiment of holder 10.

Figure 10:
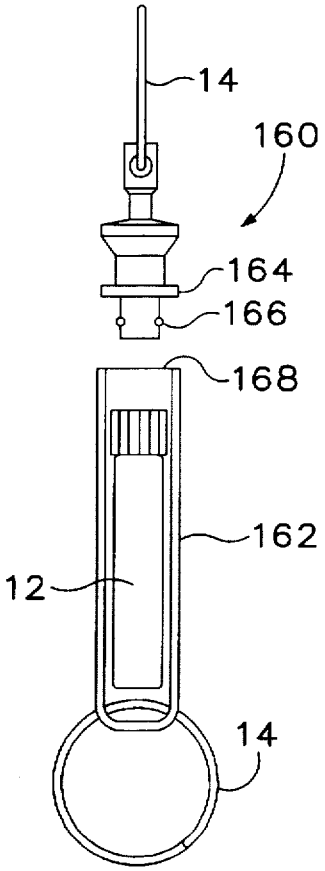
FIG. 10 is an exploded cross sectional side view of another embodiment of the vial holder apparatus.

Referring now to FIG. 10, which is an exploded cross sectional side view of another embodiment of the vial holder apparatus, holder 160 comprises a body portion 162 and a cap portion 164 including an O-ring 166 therein. In use, cap 164 is fitted within an open end 168 of body 162 such that O-ring 166 contacts the inner surface of body 162 thereby securing the cap in place. In the preferred embodiment, body 162 is manufactured of transparent glass whereas cap 164 is manufactured of resilient plastic. Holder 160 has the advantage, therefore, that vial 12 is completely surrounded while still permitting viewing of the vial. However, holder 160 is more expensive to manufacture than is the preferred embodiment of holder 10.

Figure 11:
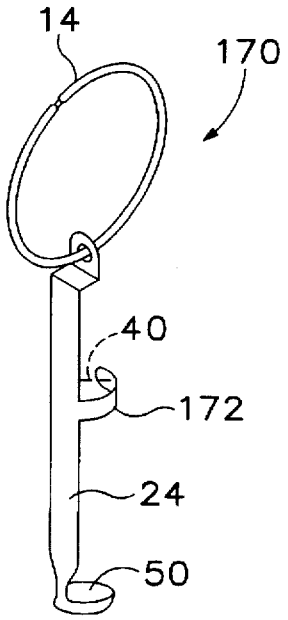
FIG. 11 is an isometric side and rear view of another embodiment of the vial holder apparatus.

Referring now to FIG. 11, which is an isometric side and rear view of another embodiment of the vial holder apparatus, holder 170 comprises a single arm 172 extending outwardly from body portion 24, and a lower support 50. Arm 172 defines a cavity having a diameter 40 sized so as to receive a vial therein. Holder 170 functions in much the same way as does holder 130 but requires a larger piece of material for manufacturing purposes due to the asymmetrical, longer span of length of single arm 172, with respect to the span of symmetrical pair of arms 132, with respect to body portion 24.

While plural embodiments of the present invention have been shown and described, it will be apparent to those skilled in the art that many changes and modifications may be made without departing from the invention in its broader aspects. The appended claims are intended therefore to cover all such changes and modifications as fall within the true spirit and scope of the invention.

I claim:

1. A vial holder comprising:

an elongate base region having upper and lower end regions;

a pair of securement arms extending generally outwardly from said base region, said arms being somewhat flexible with respect to said base region;

an upper support extending generally outwardly fr said upper end region of said base region;

a lower support extending generally outwardly from said lower end region of said base region;

wherein said pair of securement arms and said upper and lower supports define an elongate cavity sized to releasably secure therein a vial;

wherein said upper support includes an aperture sized to releasably secure therein an attachment ring; and a key chain ring releasably secured within said aperture.

2. A key chain vial holder assembly comprising:

an elongate base having lower and upper end regions;

at least one securement arm extending outwardly from said base, said arm being somewhat flexible with respect to said base;

a lower support extending generally outwardly from said lower end region of said elongate base;

an upper support extending outwardly from said upper end region of said elongate base, said upper support including an aperture sized to releasably secure therein a key chain ring, wherein said securement arm and said lower and upper supports define an elongate cavity sized to releasably secure therein a vial;

a key chain ring releasably secured within said aperture; and a vial releasably secured within said elongate cavity.

3. A key chain vial holder assembly according to claim 2 wherein said securement arm extends generally perpendicularly outwardly from said elongate base.

4. A key chain vial holder assembly according to claim 2 wherein said securement arm is generally curved so as to define a width of the elongate cavity.

5. A key chain vial holder assembly according to claim 2 wherein said vial holder is manufactured as a single integral unit.

6. A key chain vial holder assembly according to claim 2 further comprising another securement arm extending generally outwardly from said elongate base and generally parallel to said securement arm.

* * * * *